US007432815B2

(12) United States Patent
Roth et al.

(10) Patent No.: US 7,432,815 B2
(45) Date of Patent: Oct. 7, 2008

(54) MARKER FOR A MAGNETIC THEFT PROTECTION SYSTEM AND METHOD FOR ITS PRODUCTION

(75) Inventors: Ottmar Roth, Gruendau (DE); Hartwin Weber, Hanau (DE)

(73) Assignee: VACUUMSCHMELZE GmbH & Co. KG, Hanau (DE)

( * ) Notice: Subject to any disclaimer, the term of this patent is extended or adjusted under 35 U.S.C. 154(b) by 0 days.

(21) Appl. No.: 11/905,486

(22) Filed: Oct. 1, 2007

(65) Prior Publication Data

US 2008/0084308 A1 Apr. 10, 2008

Related U.S. Application Data

(60) Provisional application No. 60/828,220, filed on Oct. 5, 2006.

(51) Int. Cl.
*G08B 13/14* (2006.01)

(52) U.S. Cl. ..... 340/572.6; 340/568.1; 340/572.1; 428/611; 428/681; 148/120; 148/304; 148/310

(58) Field of Classification Search ..... 340/568.1, 340/572.1, 572.6; 428/611, 681; 148/120, 148/304, 310

See application file for complete search history.

(56) References Cited

U.S. PATENT DOCUMENTS

| | | | |
|---|---|---|---|
| 4,028,144 | A | 6/1977 | Tomishima et al. |
| 4,510,489 | A | 4/1985 | Anderson, III et al. |
| 4,536,229 | A | 8/1985 | Jin et al. |
| 5,685,921 | A | 11/1997 | Dulmaine |
| 5,729,200 | A | 3/1998 | Copeland et al. |
| 6,011,475 | A | 1/2000 | Herzer |
| 6,018,296 | A | 1/2000 | Herzer |

(Continued)

FOREIGN PATENT DOCUMENTS

| | | |
|---|---|---|
| DE | 2052710 C2 | 8/1986 |

(Continued)

OTHER PUBLICATIONS

T.H. Tiefel et al., "Microduplex Fe-Ni-Mo semihard magnet alloys," J. Appl. Phys. 55 (6), Mar. 15, 1984, (pp. 2112-2114).

(Continued)

*Primary Examiner*—George A Bugg
*Assistant Examiner*—Samuel J Walk
(74) *Attorney, Agent, or Firm*—Buchanan Ingersoll & Rooney PC.

(57) ABSTRACT

Disclosed are a marker for a magnetic theft protection system, comprising:

(a) at least one oblong alarm strip comprising an amorphous ferromagnetic alloy; and (b) at least one oblong activation strip comprising an alloy consisting essentially of formula $Ni_aMo_bX_cFe_{Rest}$, wherein X is one or more of the elements from the group including Cr, W and V, and wherein a, b, and c are weight percentages, such that 15% by weight≦a≦25% by weight, 0% by weight≦b≦2.8% by weight, 0% by weight≦c≦8% by weight; and, wherein said activation strip has a coercitive force $H_c$ of 10 A/cm to 25 A/cm and a remanence $B_r$ of at least 1.0 T; the activation strip itself, a tag containing the activation strip and/or marker, articles containing the marker or tag, methods for making the activation strip, and methods for making the marker.

26 Claims, 5 Drawing Sheets

U.S. PATENT DOCUMENTS

| | | | |
|---|---|---|---|
| 6,157,301 | A | 12/2000 | Radeloff et al. |
| 6,166,636 | A | 12/2000 | Herget et al. |
| 6,299,702 | B1 | 10/2001 | Herzer |
| 6,359,563 | B1 | 3/2002 | Herzer |
| 6,551,416 | B1 | 4/2003 | Herzer |
| 6,645,314 | B1 | 11/2003 | Herzer et al. |
| 6,663,981 | B1 | 12/2003 | Weber et al. |
| 6,803,118 | B2 | 10/2004 | Weber et al. |
| 7,026,938 | B2 | 4/2006 | Herzer |
| 7,088,247 | B2 | 8/2006 | Herzer et al. |
| 7,276,128 | B2 | 10/2007 | Herzer et al. |
| 2003/0129445 | A1 | 7/2003 | Weber et al. |

FOREIGN PATENT DOCUMENTS

| | | | |
|---|---|---|---|
| DE | 19732872 | A1 | 2/1999 |
| DE | 19740908 | C1 | 8/1999 |
| EP | 0121649 | B2 | 8/1995 |
| EP | 0944910 | B1 | 8/2002 |
| GB | 1331438 | | 9/1973 |
| WO | WO 8001857 | A1 | 9/1980 |
| WO | WO 9003652 | A1 | 4/1990 |
| WO | WO 9826434 | A1 | 6/1998 |

OTHER PUBLICATIONS

S. Jin et al., "High-Remanence Square-Loop Fe-Ni and Fe-Mn Magnetic Alloys," IEEE Transactions on Magnetics, vol. Mag. 16, No. 5, Sep. 1980, (pp. 1062-1064).

S. Jin et al., "New Ductile Fe-Mo-Ni Magnet Alloys," Bell Laboratories, Murray Hill, NJ, Abstract, Dec. 23, 1980, (3 pages).

Richard M. Bozorth, "Ferromagnetism," D. Van Nostrand Company, Inc., Princton, NJ, 1951, (pp. 148, 186, 188).

Ottmar Roth et al., "Marker For A Magnetic Theft Protection System And Method For Its Production", German Application No. 10 2006 047 022.2, International Filing Date Oct. 2, 2006, U.S. Appl. No. 11/898,024, filed Sep. 7, 2007.

MARKER FOR A MAGNETIC THEFT PROTECTION SYSTEM AND METHOD FOR ITS PRODUCTION

This application claims benefit of the filing date of U.S. Provisional Application Ser. No. 60/828,220, filed Oct. 5, 2006, the entire contents of which is incorporated by reference herein.

BACKGROUND

1. Field

The invention relates to a marker for a magnetic theft protection system comprising at least one amorphous ferromagnetic alarm strip and at least one semi-hard magnetic activation strip. These markers can be used in magneto-elastic and in harmonic theft protection systems.

2. Description of Related Art

Certain magnetic theft protection systems and markers are, for example, disclosed in EP 0 121 649 B1 and U.S. Pat. No. 5,729,200. In these theft protection systems, a detector system transmits a pulse which excites the alarm strip of the indication element, making the alarm strip vibrate with a characteristic resonant frequency. As a result, the detector system detects the alarm strip and triggers an alarm.

In magneto-elastic systems, the activation strip activates the alarm strip by means of magnetisation. In these systems, the alarm strip vibrates with a characteristic resonant frequency, while the activation strip is magnetised. The alarm strip is deactivated by a change of its resonant frequency. This is achieved by the demagnetisation of the semi-hard magnetic activation strip, making the alarm element vibrate at a different frequency which is not detected by the detector system.

In contrast to magneto-elastic systems, the magnetised activation strip of harmonic theft protection systems is used to deactivate the alarm strip.

The markers of theft protection systems are increasingly installed directly in or on the product to be secured, a method known as source tagging. In these systems, an operator is often responsible for the magnetisation or demagnetisation of the activation strip. This results in the additional requirement that it must be possible to magnetise or demagnetise the semi-hard magnetic alloy of the activation strip from a greater distance or using smaller fields.

It has been found that coercitive force has to be limited to a maximum of 25 A/cm for these applications. On the other hand, an adequate opposing field stability is also required, which determines the lower limit value of coercitive force. Only coercitive forces from 10 A/cm are suitable for this purpose. The remanence $B_r$ should be at least 1.0 T.

A semi-hard magnetic alloy with a coercitive force meeting these requirements for use as an activation strip is disclosed and exemplified in U.S. Pat. No. 5,685,921. This alloy has the composition $Ni_{20}Mo_4Fe_{Rest}$.

The extension of the range of applications for markers is desirable. The known semi-hard magnetic molybdenum-containing alloys, however, have the disadvantage that they have become more expensive in recent years owing to rising raw material costs.

SUMMARY

The present invention is therefore based on the problem of providing alternative markers, in particular alternative semi-hard magnetic alloys for an activation strip of a marker, which meet the above requirements, avoid the disadvantages of known alloys, and can be produced cost-effectively.

This problem is solved by the subject matter of the independent claims. Advantageous further developments can be derived from the dependent claims.

In one embodiment is provided a marker for a magnetic theft protection system, comprising:

(a) at least one oblong alarm strip comprising an amorphous ferromagnetic alloy; and (b) at least one oblong activation strip comprising an alloy consisting essentially of $Ni_aMo_bX_cFe_{Rest}$, wherein X is one or more of the elements from the group including Cr, W and V, and wherein a, b, and c are weight percentages, such that 15% by weight≦a≦25% by weight, 0% by weight≦b≦3.5% by weight, more particularly 0% by weight≦b≦2.8% by weight, 0% by weight≦c≦8% by weight; and, wherein said activation strip has a coercitive force $H_c$ of 10 A/cm to 25 A/cm and a remanence $B_r$ of at least 1.0 T.

This semi-hard magnetic alloy desirably contains a maximum of 3.5% by weight, more particularly of 2.8% by weight, of molybdenum, reducing raw material costs compared to the known composition $Ni_{20}Mo_4Fe_{Rest}$. The coercitive force and the remanence of the activation strip meet the above requirements. The invention therefore provides an activation strip which is more cost-effective without compromising the desired properties.

These alloys with added Cr and a reduced molybdenum content can be produced as a ductile strip, which is desirable if they are to be used as activation strips in a marker.

In one embodiment, the activation strip has a $H_c$ of 14 A/cm to 20 A/cm.

In one embodiment, the activation strip has a $B_r$>1.2 T.

In one embodiment, 0% by weight<b≦2.8% by weight, more particularly 0.5% by weight≦b≦2.8% by weight, i.e. it has an Mo content between 0 and 2.8% by weight, more particularly between 0.5 and 2.8% by weight, inclusive, resulting in a further reduction of raw material costs. In another embodiment, 1.0% by weight≦b≦2.8% by weight.

In one embodiment, the content of the X element c is 0.5% by weight≦c≦8% by weight, more particularly 0.5% by weight≦c≦5% by weight, more particularly 0.5% by weight≦c≦4% by weight, more particularly 2.0% by weight≦c≦4% by weight. In one embodiment, the semi-hard magnetic alloy consists essentially of one or more alloys selected from the group consisting of $Ni_{20}Mo_{2.5}Cr_{2.5}Fe_{Rest}$, $Ni_{20}Mo_2Cr_1Fe_{Rest}$, $Ni_{19.5}Mo_{2.2}Cr_{2.2}Fe_{Rest}$, $Ni_{19.5}Mo_{2.2}Cr_{2.5}Fe_{Rest}$, $Ni_{19.5}Mo_{2.8}Cr_{2.2}Fe_{Rest}$, $Ni_{19.5}Mo_{2.8}Cr_{2.8}Fe_{Rest}$, $Ni_{20}Mo_{2.5}Cr_{2.8}Fe_{Rest}$, $Ni_{20}Mo_{2.8}Cr_{2.5}Fe_{Rest}$, $Ni_{20.5}Mo_{2.5}Cr_{2.5}Fe_{Rest}$, $Ni_{20.5}Mo_{2.2}Cr_{2.2}Fe_{Rest}$, $Ni_{20.5}Mo_{2.2}Cr_{2.8}Fe_{Rest}$, $Ni_{20.5}Mo_{2.8}$—$Cr_{2.2}Fe_{Rest}$ and $Ni_{20.5}Mo_{2.8}Cr_{2.8}Fe_{Rest}$. In a more particular embodiment, the semi-hard magnetic alloy consists essentially of $Ni_{20}Mo_{2.5}X_{2.5}Fe_{Rest}$. All subscript numerals denote percent by weight based upon the total weight of the alloy.

The invention further provides for a tag with a marker according to any of these embodiments. The tag may comprise a housing which partially or completely covers or encloses the marker. In a further embodiment, a layer of adhesive can be placed on at least one side of the housing. The tag can therefore simply be attached by adhesive force to an object to be secured.

The invention further provides for an article or object, such as a consumer product to be sold, having a marker according to any of the above embodiments. The marker may be integrated into the object or attached thereto. The marker may be attached to the object in the form of a tag as disclosed herein.

In a further embodiment, the article may comprise packaging, e.g., packaging for a consumer product, that is provided with a marker according to any of the preceding embodiments. The packaging can be processed at the product's manufacturer, for example to produce a container. In a further step, the content of the packaging can be placed into the packaging already fitted with a marker. The marker may form part of a tag, as described herein, which is placed on or integrated with the packaging.

In a further embodiment is provided a method for the production of an activation strip for a marker for a magnetic theft protection system that comprises at least one oblong alarm strip comprising an amorphous ferromagnetic alloy and at least one oblong activation strip, said method comprising:

(a) melting a semi-hard magnetic alloy of formula $Ni_aMo_bX_cFe_{Rest}$, wherein X is one or more of the elements from the group including Cr, W and V, and wherein a, b, and c are weight percentages, such that 15% by weight≦a≦25% by weight, 0% by weight<b≦3.5% by weight, more particularly 0% by weight<b≦2.8% by weight, 0% by weight≦c≦8% by weight, in a vacuum or an inert gas atmosphere, (b) casting said melted alloy to produce an ingot;

(c) hot forming of said ingot at temperatures above approximately 1100° C. to produce a first strip;

(d) process annealing of said first strip at a temperature of approximately 900° C. to form an annealed first strip (e) cooling said annealed first strip to form a cooled annealed first strip;

(f) cold forming said cooled annealed first strip to a reduction in cross-section of approximately 65% to form a second strip;

(g) process annealing said second strip at a temperature between approximately 625° C. and 675° C. to form an annealed second strip;

(h) cold forming said annealed second strip to reduce cross-section to form a third strip, wherein the reduction in cross-section is selected such that said third strip has a remanence $B_r$>1.0 T; and (i) tempering said third strip at a defined temperature and for a defined time, said temperature and time being selected to produce an activation strip having a coercitive force $H_c$ of 10 A/cm to 25 A/cm.

In a particular embodiment of the method, an alloy consisting essentially of $Ni_aMo_bX_cFe_{Rest}$, wherein X is one or more of the elements from the group including Cr, W and V, wherein a, b, and c are weight percentages, such that 15% by weight≦a≦25% by weight, 0% by weight<b≦3.5% by weight, more particularly 0% by weight<b≦2.8% by weight, 0% by weight≦c≦8% by weight, is melted in a vacuum or an inert gas atmosphere and then cast to produce an ingot. The molten alloy may be formed by melting one or more solid pieces of previously prepared alloy, or may be formed by melting amounts of the alloy components appropriate to provide individual elements in the above ranges in the melt.

The ingot is hot-formed at a temperature above approximately 1100° C. to produce a strip, whereupon the strip is process-annealed at a temperature of approximately 900° C. and then chilled.

The cross-section of the strip is reduced by approximately 65% by cold forming, followed by annealing at a temperature of approximately 625° C. to 675° C. In a second step, the strip is cold-formed further, the reduction in cross-section being selected such that the remanence $B_r$ of the activation strip is >1.0 T, preferably >1.2 T. The strip is then tempered at a defined temperature and for a defined time. Tempering temperature and time are selected such that the activation strip has a coercitive force $H_c$ of 10 A/cm to 25 A/cm, preferably 14 A/cm to 20 A/cm.

In one variant, the cross-section of the strip is reduced by at least 80%, preferably by at least 95%, by cold forming after process annealing in order to obtain a remanence $B_r$ of >1.0 T, preferably >1.2 T.

In one variant, tempering is carried out at a temperature between 425° C. and 525° C., more particularly between 460° C. and 480° C. Tempering is such that the tempered strip has a coercitive force $H_c$ of 10 A/cm to 25 A/cm, preferably 14 A/cm to 20 A/cm.

The strip is advantageously produced as a long strip to be cut into several pieces. In this way, the activation strips are cut to length.

In another embodiment is provided a method for the production of a marker for a magnetic theft protection system, comprising:

(a) providing at least one oblong alarm strip comprising an amorphous ferromagnetic alloy;

(b) providing at least one oblong activation strip consisting essentially of $Ni_aMo_bX_cFe_{Rest}$, wherein X is one or more of the elements from the group including Cr, W and V, and wherein a, b, and c are weight percentages, such that 15% by weight≦a≦25% by weight, 0% by weight<b≦3.5% by weight, more particularly 0% by weight<b≦2.8% by weight, 0% by weight≦c≦8% by weight, wherein the activation strip has a coercitive force $H_c$ of 10 A/cm to 25 A/cm and a remanence $B_r$ of at least 1.0 T, preferably 1.2 T; and (c) placing said at least one oblong alarm strip adjacent to said at least one oblong activation strip to produce said marker.

In a more particular embodiment of this method, an oblong alarm strip made of an amorphous ferromagnetic alloy and an oblong activation strip made of a semi-hard magnetic alloy are provided. This semi-hard magnetic alloy consists essentially of $Ni_aMo_bX_cFe_{Rest}$, wherein 15% by weight≦a≦25% by weight, 0% by weight≦b≦3.5% by weight, 0% by weight≦c≦8% by weight, and wherein X is one or more of the elements from the group including Cr, W and V. The activation strip has a coercitive force $H_c$ of 10 A/cm to 25 A/cm, preferably 14 A/cm to 20 A/cm, and a remanence $B_r$ of at least 1.0 T, preferably 1.2 T.

To produce a marker, at least one alarm strip is placed on at least one activation strip. The large-area sides of the alarm strip and the activation strip are arranged on top of one another to produce a stack. In this arrangement, the activation strip can reliably bias the alarm strip, so that the alarm strip has the desired characteristic resonant frequency.

The alarm strip and the activation strip of the marker may be located in a housing and provided in the form of a tag. This tag may be removably attached to an object to be secured.

In a further variant, the alarm strip and the activation strip of the marker are placed in a packaging for a consumer product to provide a packaging with a marker.

In another embodiment, is provided an oblong activation strip suitable for a marker for a magnetic theft protection system, comprising an alloy consisting essentially of a semi-hard magnetic alloy of formula $Ni_aMo_bX_cFe_{Rest}$, wherein X is one or more of the elements from the group including Cr, W and V, and wherein a, b, and c are weight percentages, such that 15% by weight≦a≦25% by weight, 0% by weight<b≦3.5% by weight, more particularly 0% by weight<b≦2.8% by weight, 0% by weight≦c≦8% by weight; and having a coercitive force $H_c$ of 10 A/cm to 25 A/cm and a remanence $B_r$ of at least 1.0 T.

The invention is explained in greater detail with reference to the figures and specific embodiments, which are intended to exemplify the invention for ease of understanding, and are not intended to limit the scope of the appended claims.

DETAILED DESCRIPTION OF SPECIFIC EMBODIMENTS

Figure 1:
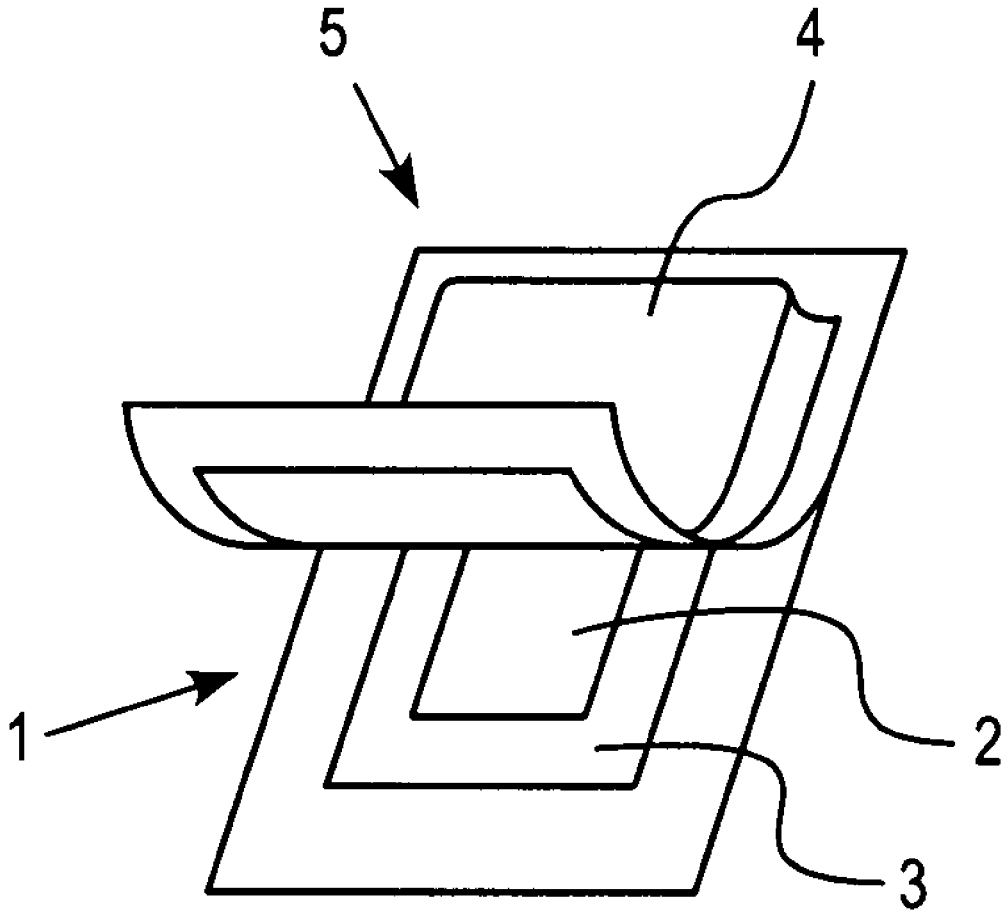
FIG. 1 is a schematic drawing showing a marker with an alarm strip and an activation strip.

FIG. 1 shows a marker 1 comprising an alarm strip 2 and an activation strip 3. A large-area side of the alarm strip 2 is placed on a large-area side of the activation strip 3, thus forming a stack. The alarm strip 2 is made of an amorphous ferromagnetic alloy, while the activation strip 3 is made of a semi-hard magnetic alloy consisting essentially of $Ni_{20}Mo_{2.5}X_{2.5}Fe_{Rest}$. The activation strip has a remanence $B_r$ of 1.33 T and a coercitive force $H_c$ of 20 A/cm.

The marker 1 is located in a housing 4 made of plastic, which has the form of a tag 5. In further embodiments not shown in the drawing, the housing 4 is an object, a consumer product or a packaging for a consumer product.

In this embodiment, the marker is destined for use in a magneto-elastic theft protection system. The activation strip 3 is therefore magnetised to activate the alarm strip 2. When excited, the alarm strip 2 vibrates in a detector system not shown in the drawing with a characteristic resonant frequency recognised by the detector system as a marker.

To produce an activation strip, alloys with a composition of $Ni_aMo_bX_cFe_{Rest}$, wherein 15% by weight$\leqq$a$\leqq$25% by weight, 0% by weight<b$\leqq$3.5% by weight,more particularly 0% by weight<b$\leqq$2.8% by weight, 0% by weight$\leqq$c$\leqq$8% by weight, are produced in the form of ductile foils.

The alloy with the desired composition is first melted in a vacuum or an inert gas atmosphere at a temperature of 1600° C. and is then cast to produce an ingot. The ingot is hot-formed at temperatures above 1000° C. to produce a strip. This strip is annealed in a first process annealing step at a temperature of approximately 1100° C. and then chilled. The strip is cold-formed to reduce its cross-section by approximately 70% and is then annealed in a second process annealing step at a temperature of 1100° C.

The strip is then cold-formed to reduce its cross-section by approximately 50% and annealed in a third process annealing step at 625° C. to 675° C. In a second cold-forming step, the cross-section is reduced by at least up to 95%. The strip is then tempered for 1 to 3 hours at a temperature between 440° C. and 520° C., whereupon the activation strips are cut to length.

Batches of alloys with a composition of $Ni_{20}Mo_{2.5}Cr_{2.5}Fe_{Rest}$, $Ni_{20}Mo_2Cr_1Fe_{Rest}$, $Ni_{19.5}Mo_{2.2}Cr_{2.8}Fe_{Rest}$, $Ni_{19.5}Mo_{2.2}Cr_{2.8}Fe_{Rest}$, $Ni_{19.5}Mo_{2.8}Cr_{2.2}Fe_{Rest}$, $Ni_{19.5}Mo_{2.8}Cr_{2.8}Fe_{Rest}$, $Ni_{20}Mo_{2.5}Cr_{2.8}Fe_{Rest}$, $Ni_{20}Mo_{2.8}Cr_{2.5}Fe_{Rest}$, $Ni_{20.5}Mo_{2.5}Cr_{2.5}Fe_{Rest}$, $Ni_{20.5}Mo_{2.2}Cr_{2.2}Fe_{Rest}$, $Ni_{20.5}Mo_{2.2}Cr_{2.8}Fe_{Rest}$, $Ni_{20.5}Mo_{2.8}Cr_{2.2}Fe_{Rest}$ and $Ni_{20.5}Mo_{2.8}$—$Cr_{2.8}Fe_{Rest}$ were produced using the general procedure described above. Examples with these compositions were processed with various degrees of reduction in cross-section and in various tempering conditions.

The magnetic properties coercitive force $H_c$, magnetisation at 40 Oe, demagnetisation at 4 Oe and demagnetisation at 20 Oe were measured. These values are listed in Table 1 and illustrated in FIGS. 2 to 4.

For use as a marker, the activation strip has to have a defined magnetisation and demagnetisation ratio. The remanence B, after an opposing field of 4 Oe should retain 90%, preferably 95%, of its original value to ensure an adequate opposing field stability. In this way, the resonant frequency of the alarm strip is not influenced by low magnetic fields in a way which would prevent the detection of the marker.

Figure 2:
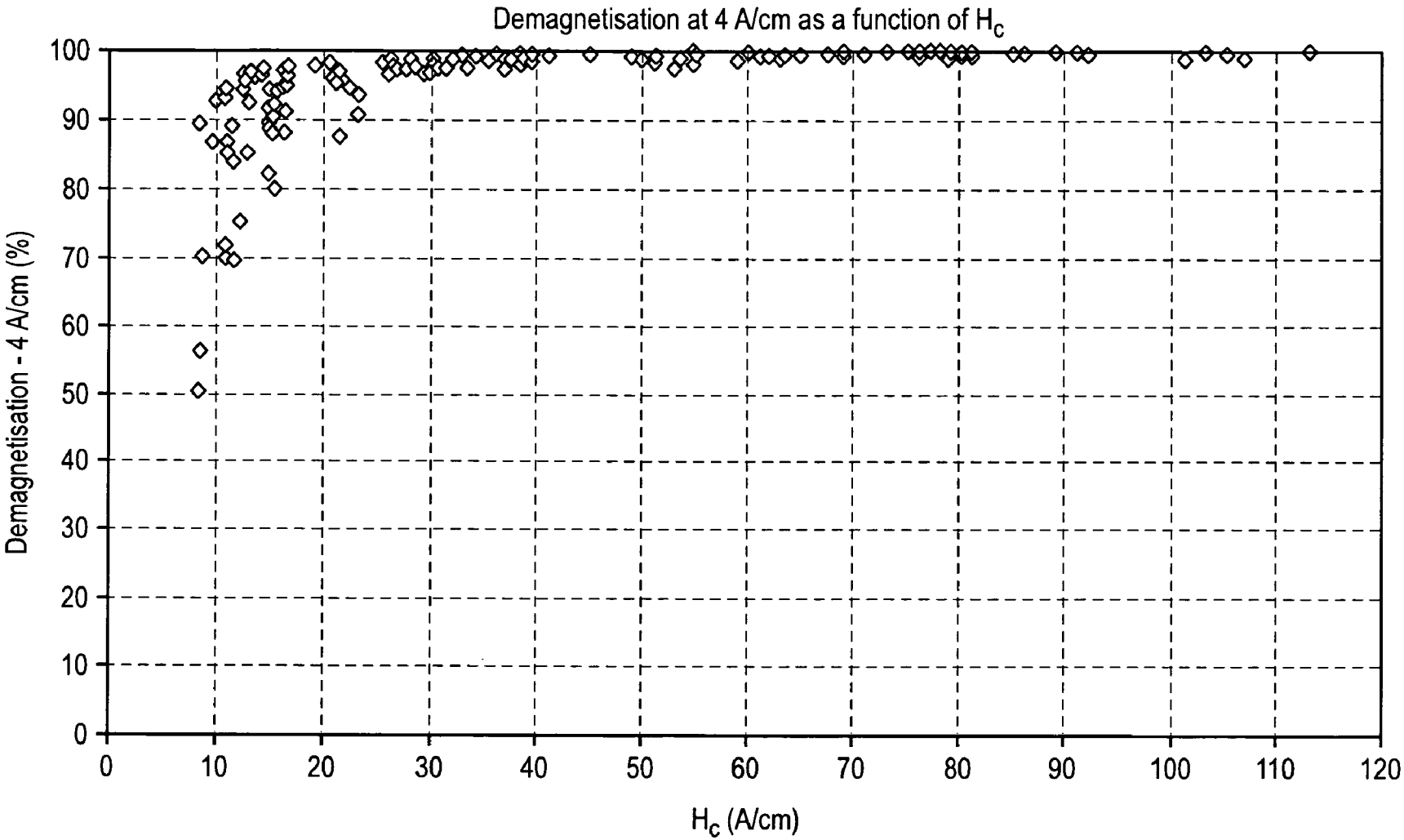
FIG. 2 is a graph that illustrates the demagnetisation behaviour of certain embodiments of semi-hard alloys described herein at 4 A/cm as a function of coercitive force.

FIG. 2 illustrates the demagnetisation behaviour at 4 A/cm as a function of coercitive force. As FIG. 2 shows, this requirement is met by the alloys according to the invention.

Following a demagnetisation cycle at 25 Oe, the remanence $B_r$ should be less than 20% of its original value to enable the activation strips to be demagnetised by smaller magnetic fields. An upper limit of 22 A/cm for coercitive field strength is desirable for rapid magnetisation.

Figure 3:
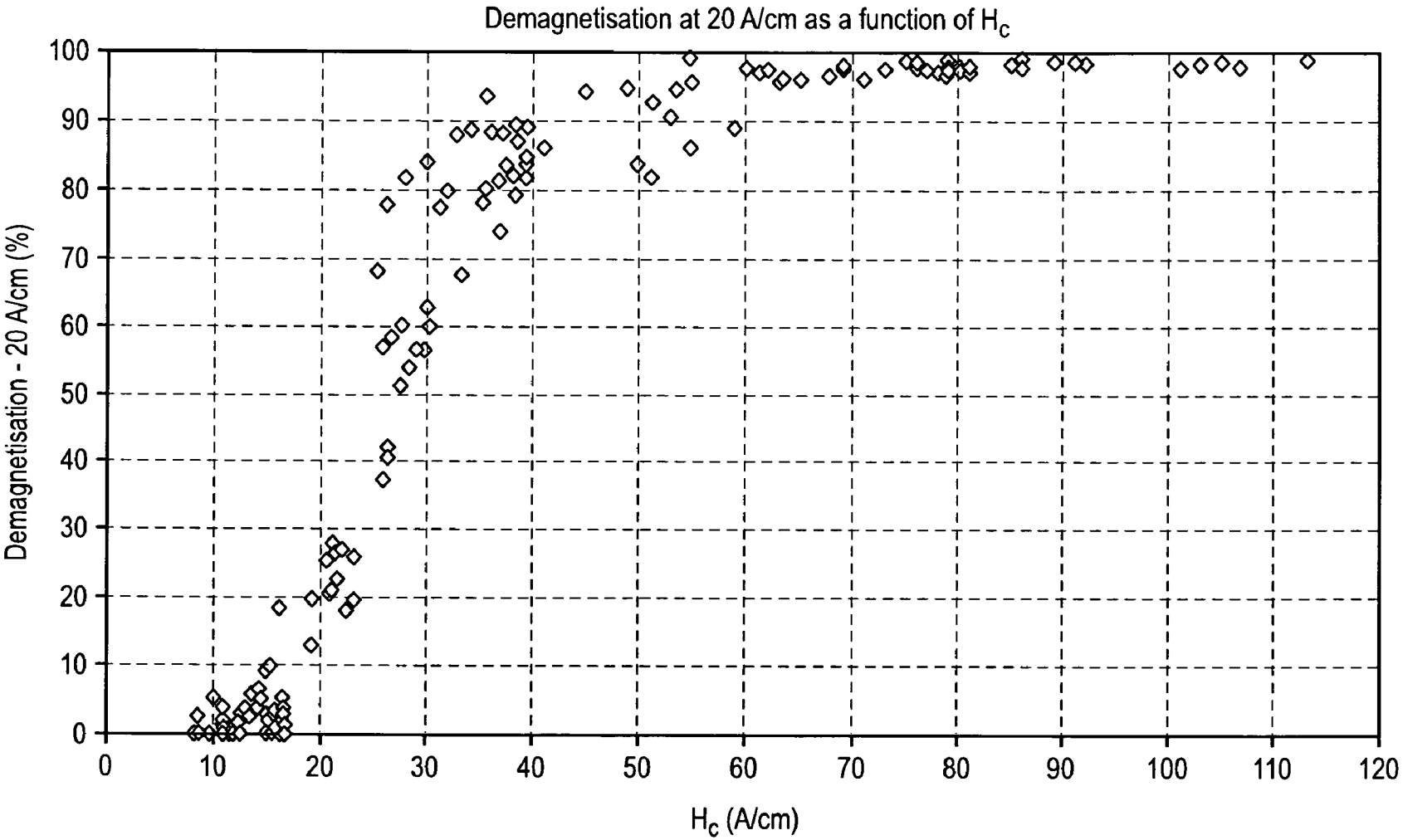
FIG. 3 is a graph that illustrates the demagnetisation behaviour of certain embodiments of semi-hard alloys described herein at 20 A/cm as a function of coercitive force.

FIG. 3 illustrates the demagnetisation behaviour at 20 A/cm as a function of coercitive force and shows that the alloys according to the invention can be demagnetised by relatively small magnetic fields. Relatively small magnetic fields are therefore capable of deactivation the markers of magneto-elastic systems and of activation those of harmonic systems.

Figure 4:
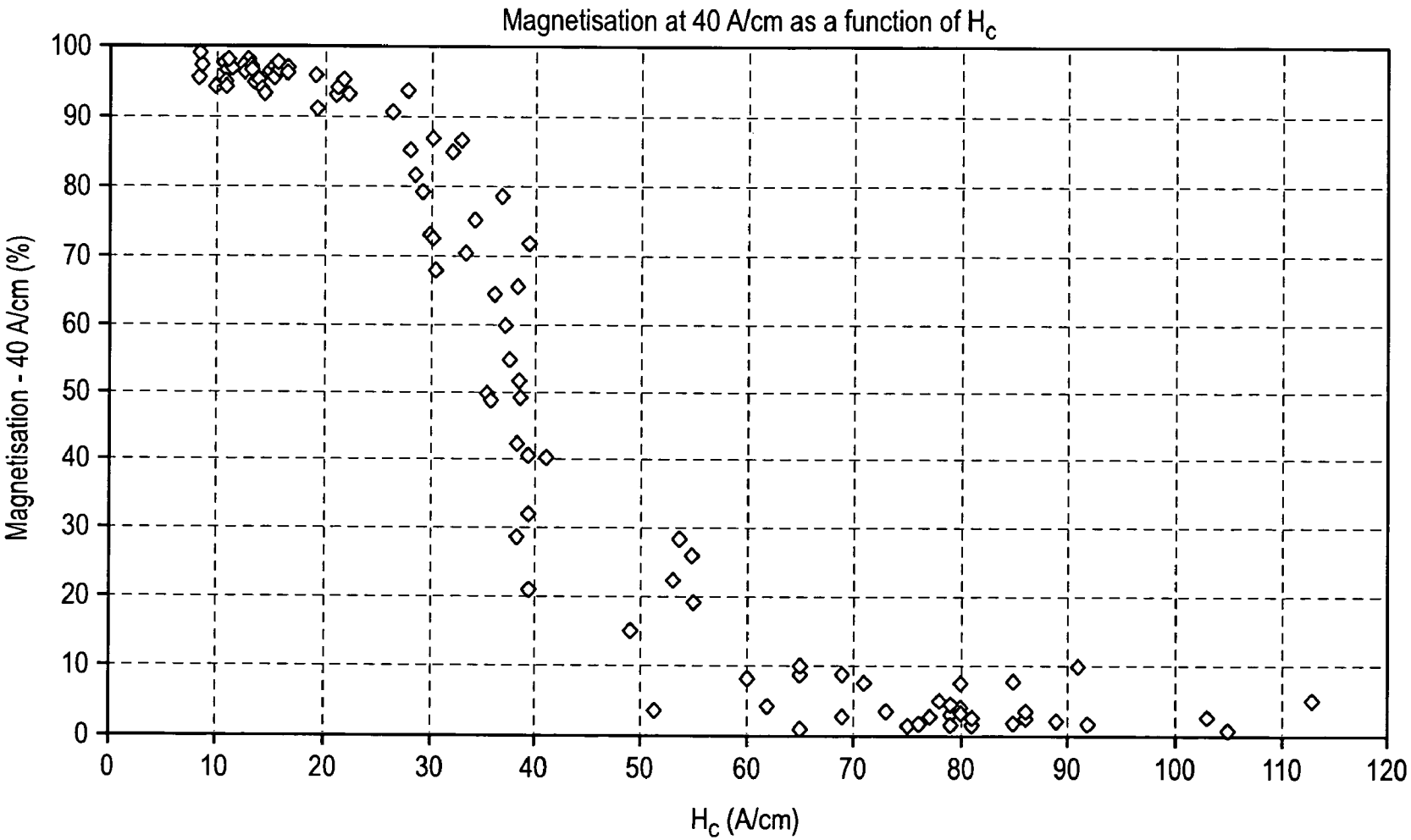
FIG. 4 is a graph that illustrates the magnetisation behaviour of certain embodiments certain semi-hard alloys described herein at 40 A/cm as a function of coercitive force.

FIG. 4 illustrates the magnetisation of the alloy according to the invention. For use as an activation strip, the ratio between the remanence at a given low magnetisation field strength and the remanence $B_r$ at a magnetic field in the kOe range should be nearly 1. FIG. 4 shows this for the alloys according to the invention.

It was found that the required magnetisation and demagnetisation behaviour is controlled by coercitive field strength.

At coercitive field strengths below approximately 10 A/cm, the remanence $B_r$ following demagnetisation at 4 Oe is less than 90%, so that the opposing field stability requirements are not met. In contrast, at coercitive field strengths above approximately 25 A/cm, the remanence after demagnetisation at 20 Oe is above 25%, so that the demagnetisation requirements are not met.

The coercitive force $H_c$ should therefore lie between 10 A/cm and 25 A/cm, so that the alloys can meet the requirements for use as activation strips of a marker. Table 1 further shows that the alloys should preferably have a coercitive force between 15 A/cm and 22 A/cm.

It was found that the coercitive force was controlled by the reduction in cross-section achieved in the cold forming and tempering process. By a suitable choice of these conditions, an alloy with a composition of $Ni_{20}Mo_{2.5}Cr_{2.5}Fe_{Rest}$, $Ni_{19.5}Mo_{2.2}Cr_{2.2}Fe_{Rest}$, $Ni_{19.5}Mo_{2.2}Cr_{2.8}Fe_{Rest}$, $Ni_{19.5}Mo_{2.8}Cr_{2.2}Fe_{Rest}$, $Ni_{19.5}Mo_{2.8}Cr_{2.8}Fe_{Rest}$, $Ni_{20}Mo_{2.5}Cr_{2.8}Fe_{Rest}$, $Ni_{20}Mo_{2.8}Cr_{2.5}Fe_{Rest}$, $Ni_{20.5}Mo_{2.5}Cr_{2.5}Fe_{Rest}$, $Ni_{20.5}Mo_{2.2}Cr_{2.2}Fe_{Rest}$, $Ni_{20.5}Mo_{2.2}Cr_{2.8}Fe_{Rest}$, $Ni_{20.5}Mo_{2.8}Cr_{2.2}Fe_{Rest}$ and $Ni_{20.5}Mo_{2.8}Cr_{2.8}Fe_{Rest}$ can be provided, which has a remanence $B_r$>1.2 T and a coercitive force $H_c$ between 10 A/cm and 25 A/cm. The alloy $Ni_{20}Mo_{2.5}Cr_{2.5}Fe_{Rest}$ has a remanence $B_r$>1.3 T and a coercitive force $H_c$ between 10 A/cm and 25 A/cm and therefore meets the requirements of an activation strip of a marker.

Figure 5:
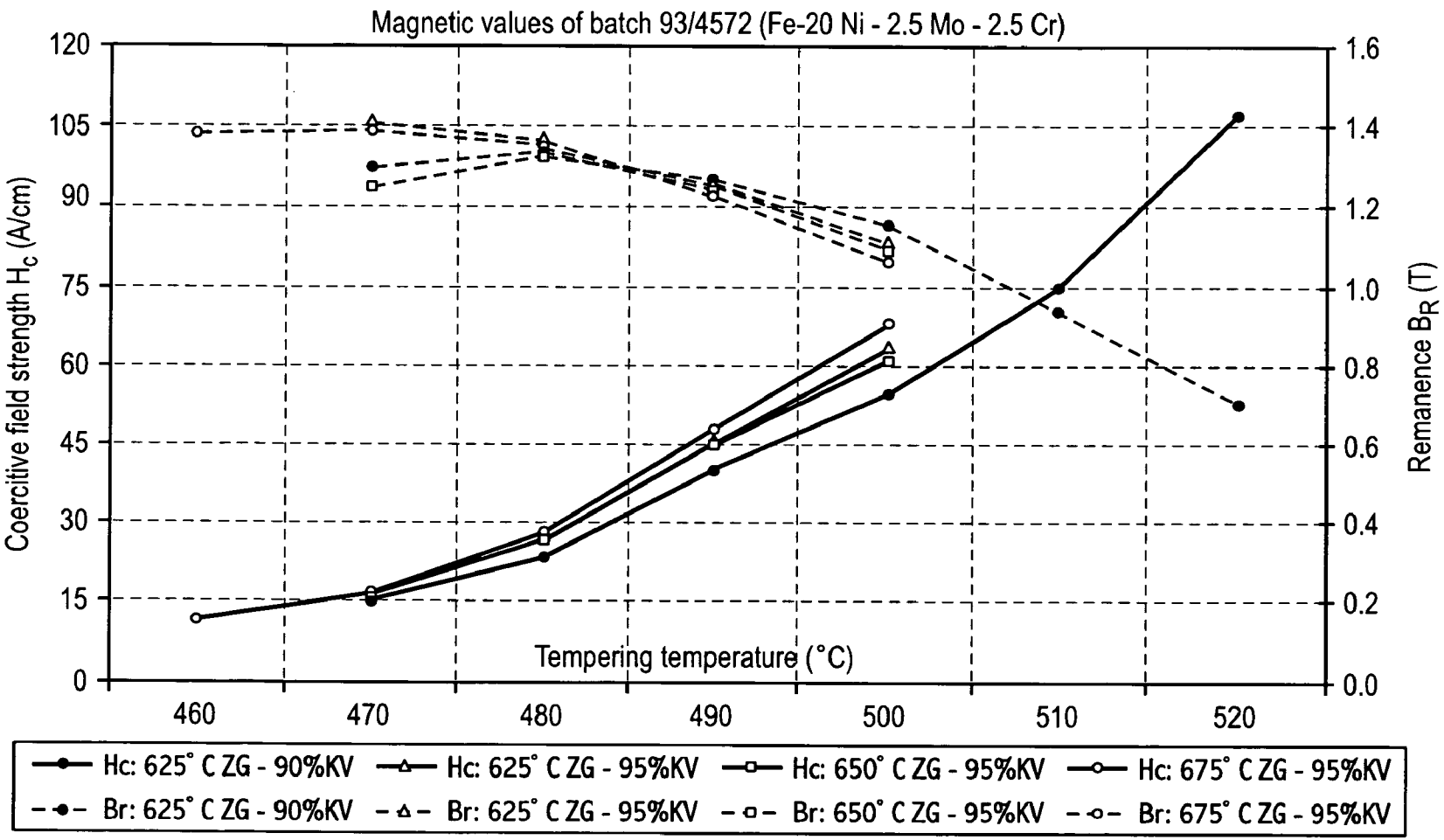
FIG. 5 is a graph that illustrates the dependence of remanence $B_r$ and coercitive field strength $H_c$ on tempering temperature and reduction in cross-section for certain embodiments of semi-hard alloys described herein.

FIG. 5 is a diagram illustrating, for an alloy with a composition of $Ni_{20}Mo_{2.5}Cr_{2.5}Fe_{Rest}$, the dependence of remanence and coercitive force on tempering temperature and cross-sectional deformation.

FIG. 5 shows that remanence and coercitive field strength are determined by the cold-forming process and by tempering temperature. Particularly striking is the dependence of coercitive field strength on tempering temperature, being approximately 7 A/cm per 5° C.

By suitable selection of these parameters, an alloy with the above desired remanence and coercitive force values can be provided. Such alloys can be used as activation strips in a marker of a theft protection system.

COMPARATIVE EXAMPLE

An alloy with a composition of $Ni_{20}Mo_4Fe_{Rest}$ (batch 93/4571) was first melted at a temperature of 1600° C. in a vacuum or an inert gas atmosphere and then cast to produce an ingot. The ingot was hot-formed at temperatures above 1000° C. to produce a strip.

This strip was annealed for 1 hour in a first process annealing step at a temperature of approximately 1100° C. and then chilled. The strip was cold-formed to reduce its cross-section by approximately 70% and then annealed in a second process annealing step for 1 hour at a temperature of 1100° C. The strip was then cold-formed to reduce its cross-section by approximately 50% and annealed for 4 hours in a second process annealing step at a temperature of 675° C.

In a third cold-forming step, the cross-section was reduced by up to 90%. The strip was then tempered for 3 hours at a temperature of 490° C.

A coercitive force of 16 A/cm and a remanence of 1.31 T were measured.

EXAMPLE

An alloy with a composition of $Ni_{20}Mo_{2.5}Cr_{2.5}Fe_{Rest}$ (batch 93/4572) was first melted at a temperature of 1600° C. in a vacuum or an inert gas atmosphere and then cast to produce an ingot. The ingot was hot-formed at temperatures above approximately 1000° C. to produce a strip.

This strip was annealed for 1 hour in a first process annealing step at a temperature of approximately 1100° C. and then chilled. The strip was cold-formed to reduce its cross-section by approximately 70% and then annealed in a second process annealing step for 1 hour at a temperature of 1100° C. The strip was then cold-formed to reduce its cross-section by approximately 50% and annealed for 4 hours in a second process annealing step at a temperature of 625° C. to 675° C.

In a third cold-forming step, the cross-section was reduced by up to 95%. The strip was then tempered for 3 hours at a temperature of 480° C.

A coercitive force of 23 A/cm and a remanence of 1.33 T were measured. This alloy is therefore suitable for use as an activation strip, as it meets the above requirements of a remanence of at least 1.3 T and a coercitive force between 10 and 25 A/cm.

This alloy contains only 2.5% by weight of Mo instead of 4% by weight. These results indicate that an activation strip can be produced from a semi-hard magnetic alloy with a reduced molybdenum content. This reduces raw material costs. It results in a low-cost activation strip suitable for use in the known markers or theft protection systems.

The invention having been described herein by reference to one or more specific embodiments or examples, it will be apparent to those of skill in the art that such embodiments and examples are not limitative of the appended claims.

TABLE 1

| | Composition | | | Hc | Mag40 | Hc | Demagnetisation 4 | Hc | Demagnetisation 20 |
|---|---|---|---|---|---|---|---|---|---|
| Charge | Ni | Mo | Cr | (A/cm) | (Mo—Cr) | (A/cm) | (Mo—Cr) | (A/cm) | (Mo—Cr) |
| 81/9908 | 20 | 2 | 1 | 8 | | 8 | 50 | 8 | 0 |
| 81/9932 | 19.5 | 2.2 | 2.2 | 8 | 95 | 8 | 89 | 8 | 0 |
| 81/9932 | 19.5 | 2.2 | 2.2 | 9 | 99 | 9 | 56 | 9 | 3 |
| 81/9932 | 19.5 | 2.2 | 2.2 | 9 | 97 | 9 | 70 | 9 | 0 |
| 93/4572 | 20 | 2.5 | 2.5 | 10 | | 10 | 87 | 10 | 0 |
| 81/9939 | 20.5 | 2.2 | 2.2 | 10 | 94 | 10 | 93 | 10 | 5 |
| 81/9933 | 19.5 | 2.2 | 2.8 | 11 | 98 | 11 | 72 | 11 | 1 |
| 81/9934 | 19.5 | 2.8 | 2.2 | 11 | 95 | 11 | 93 | 11 | 2 |
| 81/9933 | 19.5 | 2.2 | 2.8 | 11 | 94 | 11 | 95 | 11 | 4 |
| 81/9939 | 20.5 | 2.2 | 2.2 | 11 | 98 | 11 | 70 | 11 | 0 |
| 81/9933 | 19.5 | 2.2 | 2.8 | 11 | 97 | 11 | 85 | 11 | 1 |
| 81/9939 | 20.5 | 2.2 | 2.2 | 11 | 98 | 11 | 87 | 11 | 0 |
| 81/9934 | 19.5 | 2.8 | 2.2 | 12 | 97 | 12 | 89 | 12 | 1 |
| 81/9909 | 20 | | 2.5 | 12 | | 12 | 69 | 12 | 0 |
| 93/4572 | 20 | 2.5 | 2.5 | 12 | | 12 | 84 | 12 | 0 |
| 81/9934 | 19.5 | 2.8 | 2.2 | 12 | 97 | 12 | 75 | 12 | 2 |
| 81/9936 | 20 | 2.5 | 2.5 | 13 | 97 | 13 | 97 | 13 | 3 |
| 93/4572 | 20 | 2.5 | 2.5 | 13 | | 13 | 94 | 13 | 0 |
| 81/9942 | 20.5 | 2.8 | 2.2 | 13 | 97 | 13 | 96 | 13 | 4 |
| 81/9936 | 20 | 2.5 | 2.5 | 13 | 98 | 13 | 85 | 13 | 4 |
| 81/9936 | 20 | 2.5 | 2.5 | 13 | 97 | 13 | 92 | 13 | 3 |
| 81/9941 | 20.5 | 2.5 | 2.5 | 13 | 96 | 13 | 97 | 13 | 2 |
| 81/9940 | 20.5 | 2.2 | 2.8 | 14 | 95 | 14 | 96 | 14 | 6 |
| 81/9938 | 20 | 2.8 | 2.5 | 14 | 95 | 14 | 97 | 14 | 4 |
| 81/9937 | 20 | 2.5 | 2.8 | 14 | 94 | 14 | 96 | 14 | 6 |
| 81/9935 | 19.5 | 2.8 | 2.8 | 14 | 93 | 14 | 97 | 14 | 5 |
| 81/9937 | 20 | 2.5 | 2.8 | 15 | 96 | 15 | 89 | 15 | 3 |
| 81/9938 | 20 | 2.8 | 2.5 | 15 | 96 | 15 | 94 | 15 | 3 |
| 93/4572 | 20 | 2.5 | 2.5 | 15 | | 15 | 82 | 15 | 0 |
| 93/4572 | 20 | 2.5 | 2.5 | 15 | | 15 | 92 | 15 | 0 |

TABLE 1-continued

| | Composition | | | Hc | Mag40 | Hc | Demagnetisation 4 | Hc | Demagnetisation 20 |
|---|---|---|---|---|---|---|---|---|---|
| Charge | Ni | Mo | Cr | (A/cm) | (Mo—Cr) | (A/cm) | (Mo—Cr) | (A/cm) | (Mo—Cr) |
| 93/4572 | 20 | 2.5 | 2.5 | 15 | | 15 | 89 | 15 | 9 |
| 81/9937 | 20 | 2.5 | 2.8 | 15 | 97 | 15 | 94 | 15 | 2 |
| 81/9940 | 20.5 | 2.2 | 2.8 | 15 | 96 | 15 | 88 | 15 | 2 |
| 81/9942 | 20.5 | 2.8 | 2.2 | 15 | 97 | 15 | 94 | 15 | 2 |
| 93/4572 | 20 | 2.5 | 2.5 | 15 | | 15 | 91 | 15 | 10 |
| 81/9938 | 20 | 2.8 | 2.5 | 15 | 96 | 15 | 92 | 15 | 3 |
| 93/4572 | 20 | 2.5 | 2.5 | 16 | | 16 | 80 | 16 | 0 |
| 81/9940 | 20.5 | 2.2 | 2.8 | 16 | 97 | 16 | 94 | 16 | 3 |
| 81/9941 | 20.5 | 2.5 | 2.5 | 16 | 98 | 16 | 94 | 16 | 1 |
| 93/4572 | 20 | 2.5 | 2.5 | 16 | | 16 | 95 | 16 | 18 |
| 93/4572 | 20 | 2.5 | 2.5 | 16 | | 16 | 97 | 16 | 0 |
| 81/9941 | 20.5 | 2.5 | 2.5 | 16 | 97 | 16 | 88 | 16 | 1 |
| 81/9935 | 19.5 | 2.8 | 2.8 | 16 | 96 | 16 | 91 | 16 | 5 |
| 81/9935 | 19.5 | 2.8 | 2.8 | 17 | 97 | 17 | 96 | 17 | 4 |
| 81/9942 | 20.5 | 2.8 | 2.2 | 17 | 96 | 17 | 91 | 17 | 3 |
| 93/4572 | 20 | 2.5 | 2.5 | 17 | | 17 | 95 | 17 | 0 |
| 93/4572 | 20 | 2.5 | 2.5 | 17 | | 17 | 96 | 17 | 0 |
| 93/4572 | 20 | 2.5 | 2.5 | 17 | | 17 | 98 | 17 | 1 |
| 81/9932 | 19.5 | 2.2 | 2.2 | 19 | 91 | 19 | 98 | 19 | 20 |
| 81/9943 | 20.5 | 2.8 | 2.8 | 19 | 96 | 19 | 98 | 19 | 13 |
| 93/4572 | 20 | 2.5 | 2.5 | 21 | | 21 | 98 | 21 | 25 |
| 81/9943 | 20.5 | 2.8 | 2.8 | 21 | 93 | 21 | 96 | 21 | 20 |
| 81/9932 | 19.5 | 2.2 | 2.2 | 21 | 94 | 21 | 96 | 21 | 21 |
| 81/9909 | 20 | | 2.5 | 21 | | 21 | 95 | 21 | 28 |
| 81/9943 | 20.5 | 2.8 | 2.8 | 22 | 95 | 22 | 97 | 22 | 27 |
| 93/4572 | 20 | 2.5 | 2.5 | 22 | | 22 | 88 | 22 | 23 |
| 81/9932 | 19.5 | 2.2 | 2.2 | 22 | 93 | 22 | 95 | 22 | 27 |
| 93/4572 | 20 | 2.5 | 2.5 | 23 | | 23 | 94 | 23 | 18 |
| 81/9908 | 20 | 2 | 1 | 23 | | 23 | 91 | 23 | 26 |
| 93/4572 | 20 | 2.5 | 2.5 | 23 | | 23 | 94 | 23 | 19 |
| 81/9909 | 20 | | 2.5 | 25 | | 25 | 98 | 25 | 68 |
| 93/4572 | 20 | 2.5 | 2.5 | 26 | | 26 | 99 | 26 | 57 |
| 93/4572 | 20 | 2.5 | 2.5 | 26 | | 26 | 97 | 26 | 37 |
| 81/9934 | 19.5 | 2.8 | 2.2 | 26 | 91 | 26 | 99 | 26 | 78 |
| 93/4572 | 20 | 2.5 | 2.5 | 26 | | 26 | 98 | 26 | 42 |
| 93/4572 | 20 | 2.5 | 2.5 | 27 | | 27 | 98 | 27 | 41 |
| 81/9908 | 20 | 2 | 1 | 27 | | 27 | 97 | 27 | 58 |
| 93/4572 | 20 | 2.5 | 2.5 | 28 | | 28 | 97 | 28 | 51 |
| 81/9934 | 19.5 | 2.8 | 2.2 | 28 | 94 | 28 | 97 | 28 | 60 |
| 81/9933 | 19.5 | 2.2 | 2.8 | 28 | 85 | 28 | 99 | 28 | 82 |
| 81/9934 | 19.5 | 2.8 | 2.2 | 29 | 82 | 29 | 98 | 29 | 54 |
| 81/9933 | 19.5 | 2.2 | 2.8 | 29 | 79 | 29 | 97 | 29 | 57 |
| 81/9939 | 20.5 | 2.2 | 2.2 | 30 | 73 | 30 | 97 | 30 | 56 |
| 81/9939 | 20.5 | 2.2 | 2.2 | 30 | 87 | 30 | 99 | 30 | 84 |
| 81/9939 | 20.5 | 2.2 | 2.2 | 30 | 73 | 30 | 98 | 30 | 63 |
| 81/9933 | 19.5 | 2.2 | 2.8 | 31 | 68 | 31 | 98 | 31 | 60 |
| 81/9909 | 20 | | 2.5 | 31 | | 31 | 97 | 31 | 77 |
| 81/9941 | 20.5 | 2.5 | 2.5 | 32 | 85 | 32 | 99 | 32 | 80 |
| 81/9935 | 19.5 | 2.8 | 2.8 | 33 | 86 | 33 | 99 | 33 | 88 |
| 81/9936 | 20 | 2.5 | 2.5 | 33 | 70 | 33 | 98 | 33 | 67 |
| 81/9942 | 20.5 | 2.8 | 2.2 | 34 | 75 | 34 | 99 | 34 | 89 |
| 81/9938 | 20 | 2.8 | 2.5 | 35 | 50 | 35 | 99 | 35 | 78 |
| 81/9936 | 20 | 2.5 | 2.5 | 36 | 50 | 36 | 99 | 36 | 80 |
| 81/9936 | 20 | 2.5 | 2.5 | 36 | 49 | 36 | 99 | 36 | 94 |
| 81/9937 | 20 | 2.5 | 2.8 | 36 | 65 | 36 | 99 | 36 | 88 |
| 81/9935 | 19.5 | 2.8 | 2.8 | 37 | 78 | 37 | 99 | 37 | 81 |
| 93/4572 | 20 | 2.5 | 2.5 | 37 | | 37 | 97 | 37 | 74 |
| 81/9940 | 20.5 | 2.2 | 2.8 | 37 | 60 | 37 | 99 | 37 | 88 |
| 81/9938 | 20 | 2.8 | 2.5 | 38 | 55 | 38 | 99 | 38 | 83 |
| 81/9941 | 20.5 | 2.5 | 2.5 | 38 | 29 | 38 | 98 | 38 | 82 |
| 81/9937 | 20 | 2.5 | 2.8 | 38 | 42 | 38 | 99 | 38 | 79 |
| 81/9941 | 20.5 | 2.5 | 2.5 | 38 | 66 | 38 | 100 | 38 | 87 |
| 81/9938 | 20 | 2.8 | 2.5 | 39 | 52 | 39 | 98 | 39 | 89 |
| 81/9935 | 19.5 | 2.8 | 2.8 | 39 | 49 | 39 | 99 | 39 | 87 |
| 81/9940 | 20.5 | 2.2 | 2.8 | 39 | 40 | 39 | 99 | 39 | 82 |
| 81/9937 | 20 | 2.5 | 2.8 | 40 | 21 | 40 | 99 | 40 | 84 |
| 81/9942 | 20.5 | 2.8 | 2.2 | 40 | 32 | 40 | 98 | 40 | 85 |
| 81/9942 | 20.5 | 2.8 | 2.2 | 40 | 72 | 40 | 100 | 40 | 89 |
| 81/9940 | 20.5 | 2.2 | 2.8 | 41 | 40 | 41 | 99 | 41 | 86 |
| 93/4572 | 20 | 2.5 | 2.5 | 45 | | 45 | 100 | 45 | 94 |
| 81/9932 | 19.5 | 2.2 | 2.2 | 49 | 15 | 49 | 99 | 49 | 95 |
| 81/9908 | 20 | 2 | 1 | 50 | | 50 | 99 | 50 | 84 |
| 93/4572 | 20 | 2.5 | 2.5 | 51 | | 51 | 98 | 51 | 82 |
| 81/9943 | 20.5 | 2.8 | 2.8 | 51 | 3 | 51 | 99 | 51 | 93 |
| 81/9932 | 19.5 | 2.2 | 2.2 | 53 | 22 | 53 | 97 | 53 | 91 |

TABLE 1-continued

| | Composition | | | Hc | Mag40 | Hc | Demagnetisation 4 | Hc | Demagnetisation 20 |
|---|---|---|---|---|---|---|---|---|---|
| Charge | Ni | Mo | Cr | (A/cm) | (Mo—Cr) | (A/cm) | (Mo—Cr) | (A/cm) | (Mo—Cr) |
| 81/9943 | 20.5 | 2.8 | 2.8 | 54 | 28 | 54 | 99 | 54 | 95 |
| 81/9943 | 20.5 | 2.8 | 2.8 | 55 | 26 | 55 | 100 | 55 | 99 |
| 93/4572 | 20 | 2.5 | 2.5 | 55 | | 55 | 98 | 55 | 86 |
| 81/9932 | 19.5 | 2.2 | 2.2 | 55 | 19 | 55 | 99 | 55 | 95 |
| 93/4572 | 20 | 2.5 | 2.5 | 59 | | 59 | 99 | 59 | 89 |
| 81/9933 | 19.5 | 2.2 | 2.8 | 60 | 8 | 60 | 100 | 60 | 98 |
| 93/4572 | 20 | 2.5 | 2.5 | 61 | | 61 | 99 | 61 | 97 |
| 81/9934 | 19.5 | 2.8 | 2.2 | 62 | 4 | 62 | 99 | 62 | 97 |
| 93/4572 | 20 | 2.5 | 2.5 | 63 | | 63 | 99 | 63 | 96 |
| 93/4572 | 20 | 2.5 | 2.5 | 63 | | 63 | 99 | 63 | 96 |
| 81/9933 | 19.5 | 2.2 | 2.8 | 65 | 1 | 65 | 99 | 65 | 96 |
| 81/9934 | 19.5 | 2.8 | 2.2 | 65 | 9 | 65 | 100 | 65 | 96 |
| 81/9939 | 20.5 | 2.2 | 2.2 | 65 | 10 | 65 | 100 | 65 | 96 |
| 93/4572 | 20 | 2.5 | 2.5 | 68 | | 68 | 99 | 68 | 97 |
| 81/9933 | 19.5 | 2.2 | 2.8 | 69 | 3 | 69 | 99 | 69 | 98 |
| 81/9934 | 19.5 | 2.8 | 2.2 | 69 | 9 | 69 | 100 | 69 | 98 |
| 81/9936 | 20 | 2.5 | 2.5 | 71 | 7 | 71 | 100 | 71 | 96 |
| 81/9935 | 19.5 | 2.8 | 2.8 | 73 | 3 | 73 | 100 | 73 | 98 |
| 81/9939 | 20.5 | 2.2 | 2.2 | 75 | 1 | 75 | 100 | 75 | 99 |
| 81/9936 | 20 | 2.5 | 2.5 | 76 | 2 | 76 | 99 | 76 | 98 |
| 81/9939 | 20.5 | 2.2 | 2.2 | 76 | 1 | 76 | 100 | 76 | 99 |
| 81/9942 | 20.5 | 2.8 | 2.2 | 77 | 2 | 77 | 100 | 77 | 98 |
| 81/9937 | 20 | 2.5 | 2.8 | 78 | 5 | 78 | 100 | 78 | 97 |
| 93/4572 | 20 | 2.5 | 2.5 | 79 | | 79 | 99 | 79 | 97 |
| 81/9936 | 20 | 2.5 | 2.5 | 79 | 3 | 79 | 100 | 79 | 99 |
| 81/9938 | 20 | 2.8 | 2.5 | 79 | 1 | 79 | 100 | 79 | 98 |
| 81/9940 | 20.5 | 2.2 | 2.8 | 79 | 4 | 79 | 100 | 79 | 97 |
| 81/9935 | 19.5 | 2.8 | 2.8 | 80 | 4 | 80 | 100 | 80 | 98 |
| 81/9938 | 20 | 2.8 | 2.5 | 80 | 7 | 80 | 100 | 80 | 98 |
| 81/9940 | 20.5 | 2.2 | 2.8 | 80 | 3 | 80 | 100 | 80 | 97 |
| 81/9935 | 19.5 | 2.8 | 2.8 | 81 | 1 | 81 | 100 | 81 | 97 |
| 81/9937 | 20 | 2.5 | 2.8 | 81 | 1 | 81 | 99 | 81 | 98 |
| 81/9941 | 20.5 | 2.5 | 2.5 | 81 | 2 | 81 | 100 | 81 | 98 |
| 81/9940 | 20.5 | 2.2 | 2.8 | 85 | 8 | 85 | 100 | 85 | 98 |
| 81/9942 | 20.5 | 2.8 | 2.2 | 85 | 2 | 85 | 100 | 85 | 98 |
| 81/9937 | 20 | 2.5 | 2.8 | 86 | 2 | 86 | 100 | 86 | 99 |
| 81/9941 | 20.5 | 2.5 | 2.5 | 86 | 3 | 86 | 100 | 86 | 98 |
| 81/9942 | 20.5 | 2.8 | 2.2 | 89 | 2 | 89 | 100 | 89 | 99 |
| 81/9941 | 20.5 | 2.5 | 2.5 | 91 | 10 | 91 | 100 | 91 | 99 |
| 81/9938 | 20 | 2.8 | 2.5 | 92 | 1 | 92 | 100 | 92 | 99 |
| 93/4572 | 20 | 2.5 | 2.5 | 101 | | 101 | 99 | 101 | 98 |
| 81/9943 | 20.5 | 2.8 | 2.8 | 103 | 3 | 103 | 100 | 103 | 98 |
| 81/9943 | 20.5 | 2.8 | 2.8 | 105 | 1 | 105 | 100 | 105 | 99 |
| 93/4572 | 20 | 2.5 | 2.5 | 107 | | 107 | 99 | 107 | 98 |
| 81/9943 | 20.5 | 2.8 | 2.8 | 113 | 5 | 113 | 100 | 113 | 99 |

What is claimed is:

1. A marker for a magnetic theft protection system, comprising:

(a) at least one oblong alarm strip comprising an amorphous ferromagnetic alloy; and (b) at least one oblong activation strip comprising an alloy consisting essentially of formula $Ni_aMo_bX_cFe_{Rest}$, wherein X is one or more of the elements from the group including Cr, W and V, and wherein a, b, and c are weight percentages, such that 15% by weight≦a≦25% by weight, 0% by weight≦b≦2.8% by weight, 0% by weight≦c≦8% by weight; and, wherein said activation strip has a coercitive force $H_c$ of 10 A/cm to 25 A/cm and a remanence $B_r$ of at least 1.0 T.

2. The marker according to claim 1, wherein said remanence $B_r$ is at least 1.2 T.

3. The marker according to claim 1, wherein said coercitive force $H_c$ between 14 A/cm and 20 A/cm.

4. The marker according to of claim 1, wherein b is a weight percentage such that 0.5% by weight≦b≦2.8% by weight.

5. The marker according to claim 4, wherein 1.0% by weight≦b≦2.8% by weight.

6. The marker according to claim 1, wherein c is a weight percentage such that 0.5% by weight≦c≦8% by weight.

7. The marker according to claim 6, wherein 0.5% by weight≦c≦5% by weight.

8. The marker according to claim 7, wherein 2.0% by weight≦c≦4.0% by weight.

9. A tag, comprising a marker according to claim 1.

10. The tag according to claim 9, further comprising a housing enclosing said marker.

11. The tag according to claim 10, further comprising a layer of adhesive is applied to at least one side of said housing.

12. An article comprising a marker according to claim 1.

13. An article comprising a tag according to claim 9.

14. The article of claim 12, wherein said article comprises a consumer product or packaging.

15. A method for the production of an activation strip for a marker for a magnetic theft protection system that comprises at least one oblong alarm strip comprising an amorphous ferromagnetic alloy and at least one oblong activation strip, said method comprising:

(a) melting a semi-hard magnetic alloy of formula $Ni_aMo_bX_cFe_{Rest}$, wherein X is one or more of the elements from the group including Cr, W and V, and wherein a, b, and c are weight percentages, such that 15% by weight≦a≦25% by weight, 0% by weight<b≦2.8% by weight, 0% by weight≦c≦8% by weight, in a vacuum or an inert gas atmosphere, (b) casting said melted alloy to produce an ingot;

(c) hot forming of said ingot at temperatures above approximately 1100° C. to produce a first strip;

(d) process annealing of said first strip at a temperature of approximately 900° C. to form an annealed first strip (e) cooling said annealed first strip to form a cooled annealed first strip;

(f) cold forming said cooled annealed first strip to a reduction in cross-section of approximately 65% to form a second strip;

(g) process annealing said second strip at a temperature between approximately 625° C. and 675° C. to form an annealed second strip;

(h) cold forming said annealed second strip to reduce cross-section to form a third strip, wherein the reduction in cross-section is selected such that said third strip has a remanence $B_r$>1.0 T; and (i) tempering said third strip at a defined temperature and for a defined time, said temperature and time being selected to produce an activation strip having a coercitive force $H_c$ of 10 A/cm to 25 A/cm.

16. The method according to claim 15, wherein said cold forming of said annealed second strip corresponds to a reduction in cross-section of at least 80%.

17. The method according to claim 15, wherein said tempering is carried out at a temperature between 425° C. to 525° C.

18. The method according to claim 15, further comprising cutting said activation strips to length.

19. The method according to claim 15, wherein 0.5% by weight≦b≦2.8% by weight.

20. The method according to claim 15, wherein 0.5% by weight≦c≦8% by weight.

21. A method for the production of a marker for a magnetic theft protection system, comprising:

(a) providing at least one oblong alarm strip comprising an amorphous ferromagnetic alloy;

(b) providing at least one oblong activation strip consisting essentially of $Ni_aMo_bX_cFe_{Rest}$, wherein X is one or more of the elements from the group including Cr, W and V, and wherein a, b, and c are weight percentages, such that 15% by weight≦a≦25% by weight, 0% by weight<b≦2.8% by weight, 0% by weight≦c≦8% by weight, wherein the activation strip has a coercitive force $H_c$ of 10 A/cm to 25 A/cm and a remanence $B_r$ of at least 1.0 T; and (c) placing said at least one oblong alarm strip adjacent to said at least one oblong activation strip to produce said marker.

22. The method according to claim 21, further comprising locating said alarm strip and said activation strip in a housing.

23. The method according to claim 21, further comprising locating said alarm strip and said activation strip in a packaging of a consumer product.

24. The method according to claim 21, wherein 0.5% by weight≦b≦2.8% by weight.

25. The method according to claim 21, wherein 0.5% by weight≦c≦8% by weight.

26. The method according to claim 21, wherein the remanence $B_r$ is at least 1.2 T.

* * * * *

UNITED STATES PATENT AND TRADEMARK OFFICE

CERTIFICATE OF CORRECTION

PATENT NO. : 7,432,815 B2
APPLICATION NO. : 11/905486
DATED : October 7, 2008
INVENTOR(S) : Ottmar Roth et al.

It is certified that error appears in the above-identified patent and that said Letters Patent is hereby corrected as shown below:

Column 2, lines 13 to 14: change
"weight ≤b≤3.5% by weight, more particularly 0% by weight ≤b≤2.8% by weight," to
-- weight <b≤3.5% by weight, more particularly 0% by weight <b≤2.8% by weight --.

Column 2, line 47: change
"$Ni_{19.5}Mo_{2.2}Cr_{2.5}Fe_{Rest}$," to -- $Ni_{19.5}Mo_{2.2}Cr_{2.8}Fe_{Rest}$ --.

Column 4, line 39: change
"0% by weight ≤b≤ 3.5% by weight" to -- 0% by weight <b ≤3.5% by weight --.

Column 5, line 67: change
"$Ni_{19.5}Mo_{2.2}Cr_{2.8}Fe_{Rest}$" to -- $Ni_{19.5}Mo_{2.2}Cr_{2.2}Fe_{Rest}$ --.

Column 11, line 55: change
"0% by weight ≤b≤2.8% by weight" to -- 0% by weight <b≤2.8% by weight --.

Signed and Sealed this

Fourteenth Day of April, 2009

John Doll

JOHN DOLL
*Acting Director of the United States Patent and Trademark Office*